US008544400B2

(12) United States Patent
Hovik

(10) Patent No.: US 8,544,400 B2
(45) Date of Patent: Oct. 1, 2013

(54) MOORING ARRANGEMENT

(75) Inventor: Jon Hovik, Faervik (NO)

(73) Assignee: Aker Pusnes AS, Oslo (NO)

( * ) Notice: Subject to any disclaimer, the term of this patent is extended or adjusted under 35 U.S.C. 154(b) by 265 days.

(21) Appl. No.: 13/054,779

(22) PCT Filed: Jul. 16, 2009

(86) PCT No.: PCT/NO2009/000266

§ 371 (c)(1),
(2), (4) Date: Jun. 9, 2011

(87) PCT Pub. No.: WO2010/008302

PCT Pub. Date: Jan. 21, 2010

(65) Prior Publication Data

US 2011/0237142 A1 Sep. 29, 2011

(30) Foreign Application Priority Data

Jul. 16, 2008 (NO) ..... 20083166

(51) Int. Cl.

| | |
|---|---|
| ***B63B 21/00*** | (2006.01) |
| ***B63B 21/18*** | (2006.01) |
| ***B63B 21/50*** | (2006.01) |
| ***B63B 22/02*** | (2006.01) |

(52) U.S. Cl.
USPC ..... 114/200; 114/230.1; 114/293

(58) Field of Classification Search
USPC ..... 114/179, 199, 200, 230.1, 230.12, 114/230.2, 230.23, 230.26, 264, 265, 293; 441/3–5
See application file for complete search history.

(56) References Cited

U.S. PATENT DOCUMENTS

| | | | | |
|---|---|---|---|---|
| 3,766,874 | A * | 10/1973 | Helm et al. | 114/264 |
| 3,886,882 | A * | 6/1975 | Thornburg et al. | 114/40 |
| 4,048,943 | A * | 9/1977 | Gerwick, Jr. | 114/256 |
| 5,517,937 | A | 5/1996 | Lunde | |
| 5,893,334 | A | 4/1999 | Poranski, Sr. | |
| 2008/0029013 | A1 | 2/2008 | Finn et al. | |

FOREIGN PATENT DOCUMENTS

| | | |
|---|---|---|
| EP | 0 259 072 A1 | 3/1988 |
| JP | 62 241788 | 10/1987 |
| JP | 10 016877 | 1/1998 |
| WO | WO 87/06555 | 11/1987 |
| WO | WO 2008/067406 | 6/2008 |

OTHER PUBLICATIONS

International Search Report for International Application No. PCT/NO2009/000266, dated Nov. 25, 2009 (5 pages).
Written Opinion of the International Searching Authority for International Application No. PCT/NO2009/000266, dated Nov. 25, 2009 (8 pages).
Norwegian Search Report corresponding to Norway 20083166, mailing date Apr. 1, 2009 (1 page).

* cited by examiner

*Primary Examiner* — Ajay Vasudeva
(74) *Attorney, Agent, or Firm* — Myers Bigel Sibley & Sajovec, PA

(57) ABSTRACT

A mooring arrangement for a semi-submersible offshore structure having an outer hull with a lower (2) and an upper (1) water line, comprises a mooring line (4) extending from a fixed point on the seabed to an attachment on the offshore structure, at least a portion of the mooring line closest to the attachment being a chain. The attachment comprises a hawse (10) and a chain stopper (22) located below the lower water line. The chain stopper (22) is located in a dry space inside the outer hull and is sealingly attached at one end to the hawse and at the opposite end to a chain pipe (9) which extends inside the hull to above the upper water line. The hawse extends outwards from the chain stopper and is sealed to an opening in the outer hull.

10 Claims, 12 Drawing Sheets

MOORING ARRANGEMENT

CROSS REFERENCE TO RELATED APPLICATIONS

This application is a 35 U.S.C. §371 national stage application of PCT International Application No. PCT/NO2009/000266, filed on 16 Jul. 2009, which claims the benefit of priority of Norwegian Patent Application No. 20083166 filed Jul. 16, 2008. The above-referenced PCT International Application was published in the English language as International Publication No. WO 2010/008302 A1 on 21 Jan. 2010. The disclosures of both of the above referenced applications are hereby incorporated herein in their entireties by reference.

FIELD OF THE INVENTION

The present invention relates to a mooring arrangement for a semi-submersible offshore structure, such as a platform, specifically designed for operation in Arctic conditions.

BACKGROUND

Operations in Artie waters put large demands on crew and equipment due to the harsh climate. Large icebergs that are adrift in open waters, or multi-year ice ridges of substantial mass and stiffness that are drifting with the surface ice, could pose threats to moored floating installations. This makes it necessary to be able to disconnect and move the installations out of danger on short notice, and to be able to re-connect in an effective manner.

SUMMARY OF THE INVENTION

The object of the invention is to provide a mooring arrangement that allows a moored structure to be disconnected and quickly relocated in case of danger.

This is achieved in an arrangement according to the appended claims. In particular a mooring arrangement for a semi-submersible offshore structure having an outer hull with a lower and an upper water line, said mooring arrangement comprising a mooring line, extending from a fixed point on the seabed to an attachment on the offshore structure, at least a portion of the mooring line closest to the attachment being a chain, and the attachment comprising a hawse and chain stopper located below said lower water line, characterized in that the chain stopper is located in a dry space inside the outer hull, in that the chain stopper is sealingly attached at one end to the hawse and at the opposite end to a chain pipe which extends inside said hull to above said upper water line and in that the hawse extends outwards from the chain stopper to, and sealingly with, an opening in said outer hull.

Advantages of the inventive mooring arrangement include the ability of a safe quick release of the mooring lines. It also allows for easy retrieval, connection and maintenance of the mooring system. Mooring lines can be released under full tension up to mooring line breaking load. The arrangement allows for simple connection and maintenance procedures. The arrangement has sound anti-chaffing and low chain fatigue design features. The arrangement can be operated by stored energy independently of the platform energy supply.

BRIEF DESCRIPTION OF THE DRAWINGS

The invention will now be described in detail in reference to the appended drawings, in which.

DETAILED DESCRIPTION

Figure 1:
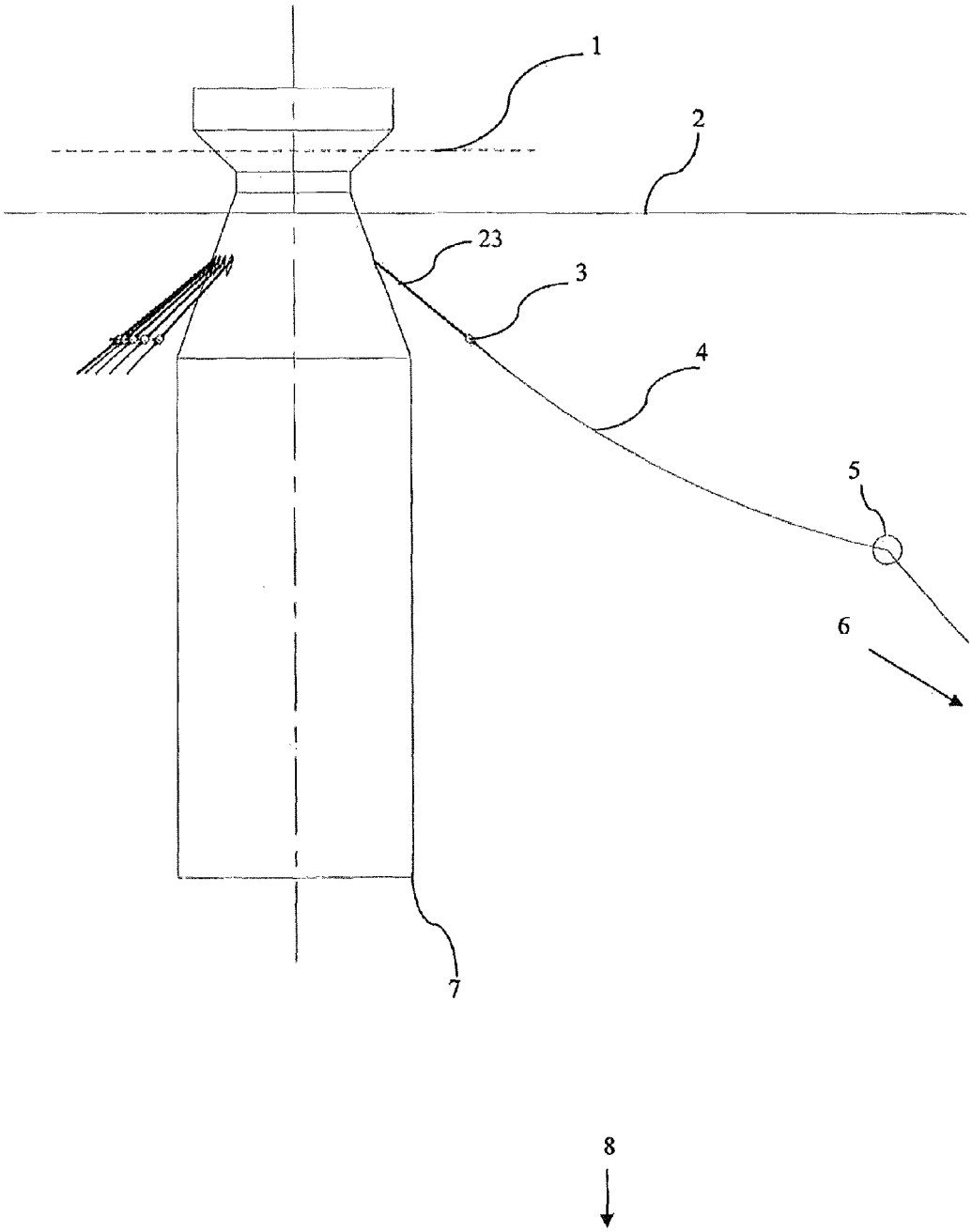
FIG. 1 is an overview picture showing a floating platform moored using the inventive arrangement.

FIG. 1 shows a semi-submersible platform, 7, floating in the sea. The platform, 7, is moored to the seabed, 8, with a number of mooring lines, 4. The mooring lines, 4, enter the platform, 7, hull through hawseholes with flared guides well below the water line, 1, 2 (the winter and summer water line, respectively). Each mooring line, 4, is made fast by a quick release chain stopper, 22, placed directly inboard of the hawsehole, 10.

Figure 4:
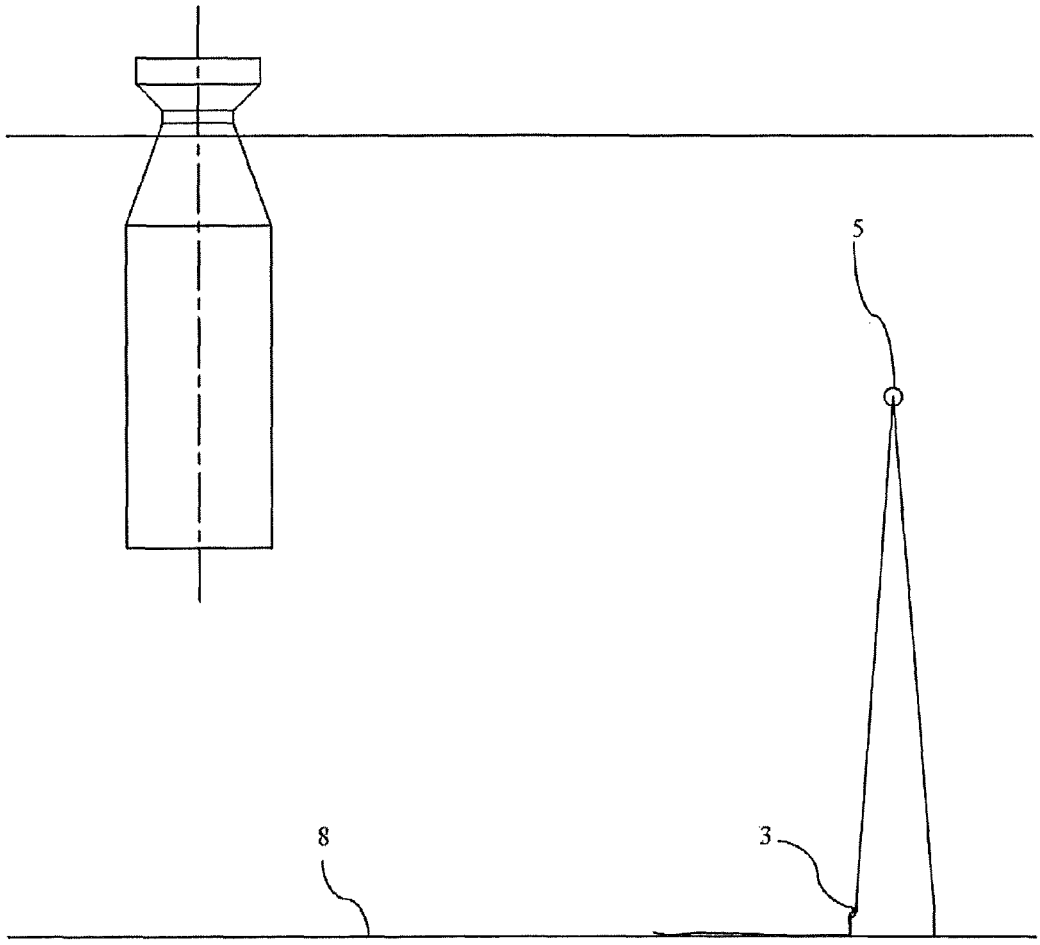
FIG. 4 is a view of the platform when released from the mooring.

The mooring lines, 4, are equipped with chain link top end sections, 23. The rest of the mooring line, 4, may consist of several different line types and attachments. The mooring line, 4, may be equipped with a retrieval buoy, 3, fitted with a grab handle to facilitate picking up the mooring line, 4, off the seabed, 8, after a release. The mooring line, 4, may also be equipped with a mid-line spring buoy, 5, which during release pulls the top end chain and upper mooring line, 4, section horizontally towards the anchor, 6, position. This reduces the chance of the mooring lines, 4, entangling and protects any subsea installations. This is illustrated in FIG. 4 which shows the situation when a mooring line, 4, has been released. The mooring line, 4, is now lying on the seabed, 8, except that the mid part of the line is pulled upward by the spring buoy, 5, which also lifts the retrieval buoy, 3, a little distance off the seabed, 8.

Figure 2:
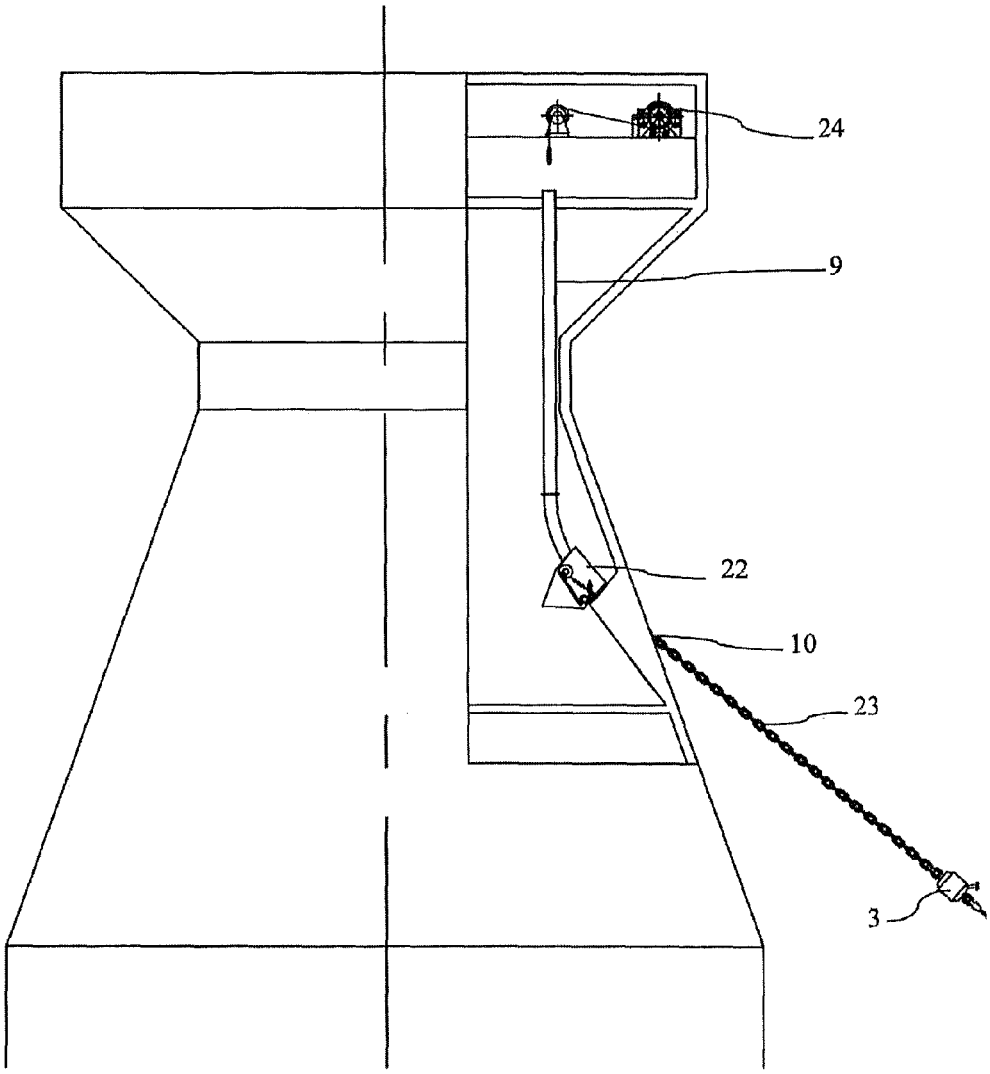
FIG. 2 is a picture of the in-hull parts of the inventive arrangement.

FIG. 2 shows the mooring arrangement on the platform, 7. The mooring line, 4, enters the platform, 7, hull through the hawsehole and is made fast in the chain stopper which has a flooded inner cavity and a water tight casing. The hawsehole and chain stopper have a sealed connection. All mechanical operating components and electrical sensors are on the dry side of the water tight casing and easily accessible from within the hull of the platform, 7. The chain stopper has a through-bore and opening upwards to which is connected a J-shaped chain pipe, 9, rising vertically to above water line. The chain stopper and the chain pipe, 9, have a sealed connection. The mooring lines, 4, are tensioned by pull-in winches, 24, operating from a height above the top of the chain pipes.

Figure 6:
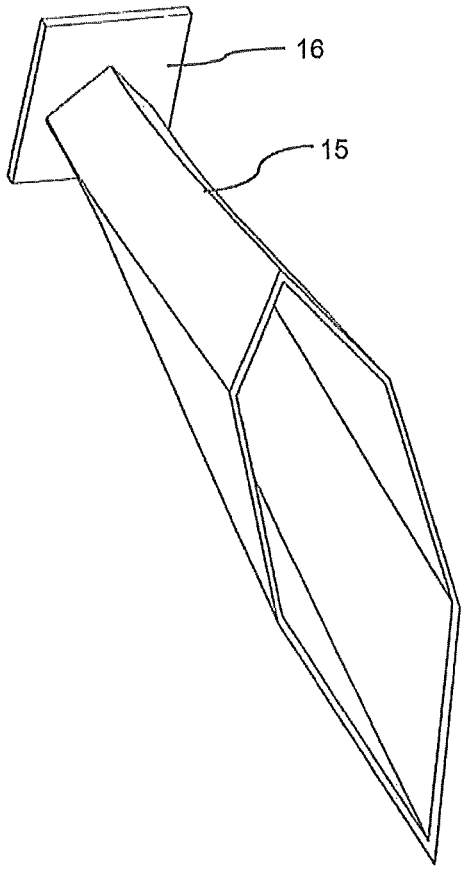
FIG. 6 shows the hawsehole arrangement in detail.

FIG. 6 shows the hawsehole in detail. The mooring line, 4, top chain enters the hull through an underwater hawsehole with flared guide, 15, to avoid chain contact with side walls under normal operating conditions. The inboard edges of the flared guide are welded to the outboard face of a foundation plate, 16.

Figure 3:
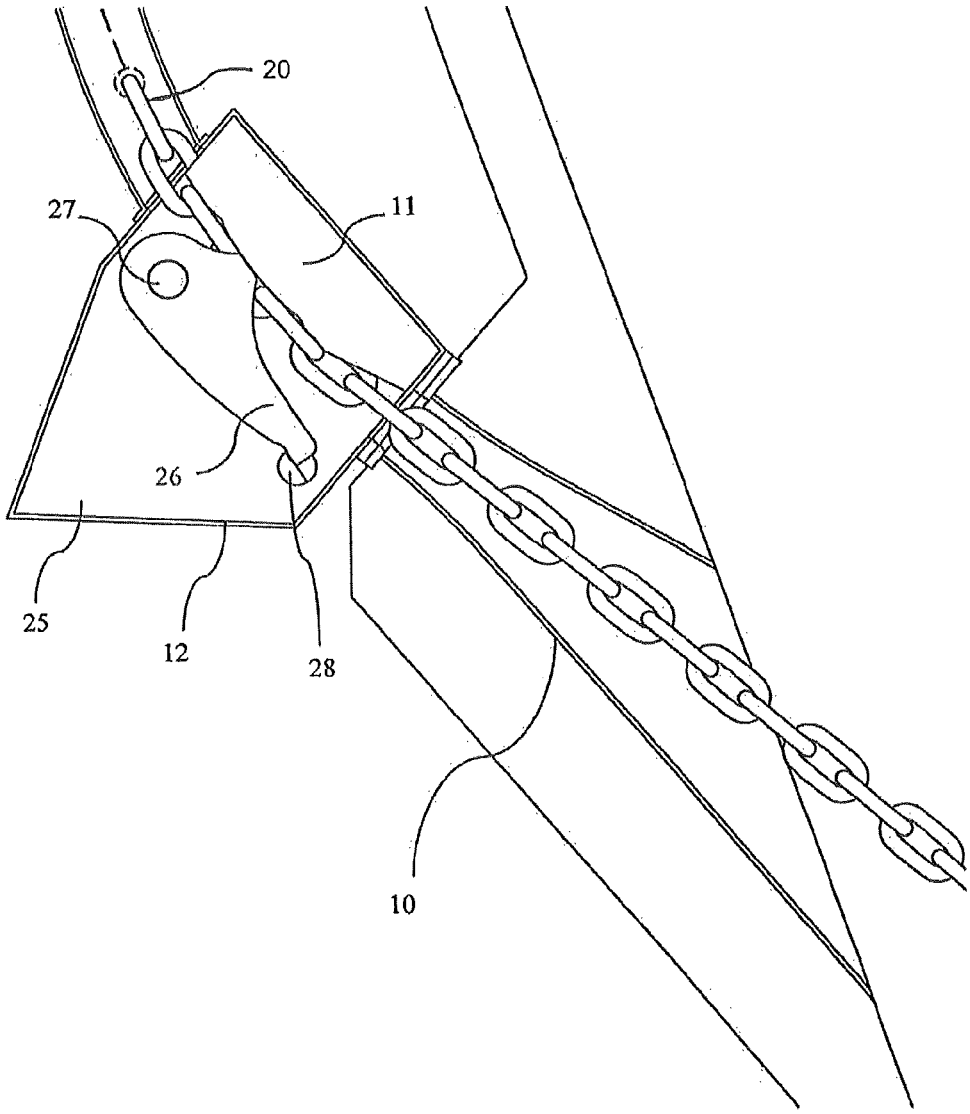
FIG. 3 is a detailed view of the chain stopper arrangement

FIG. 3 shows the chain stopper arrangement, 22, in further detail. The flared guide, 10, of the hawsehole ensured that there are sufficient clearances around the top chain outwards of the chain stopper such that no contact with other surfaces occurs from movements under normal operating conditions. In the chain stopper cavity, 25, the chain is held between a chain guide, 11, and a chain stopping device, 26. The chain stopping device, 26, is an elongated member with a first end that is fastened to rotating stopper shaft, 27. The second end, 20, is held fixed (i.e. as shown in the figure) in a releasable locking device. The locking device includes a rotating locking shaft, 28, with a semi-circular cut out (actually the cut out is a little more than 180°). Due to this cut out, a locking surface is formed on which the second end, 20, of the chain stopping device will rest when in the locked position as shown in the figure. By rotating the locking shaft, to 28, the chain stopping device, 26, is released. The said shafts are penetrating the watertight housing, 12, of the chain stopper. Seals ensure that the mechanism operating the chain stopping device and locking device inside the chain stopper cavity may be mounted in dry space within the hull.

Figure 7:
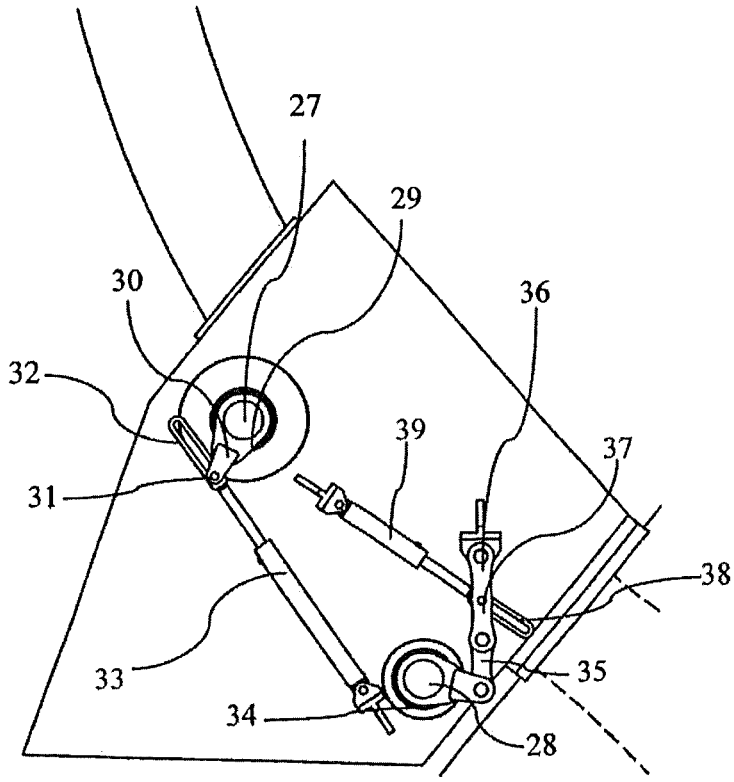
FIGS. 7 and 8 shows the chain stopper arrangement holding the chain.
Figure 8:
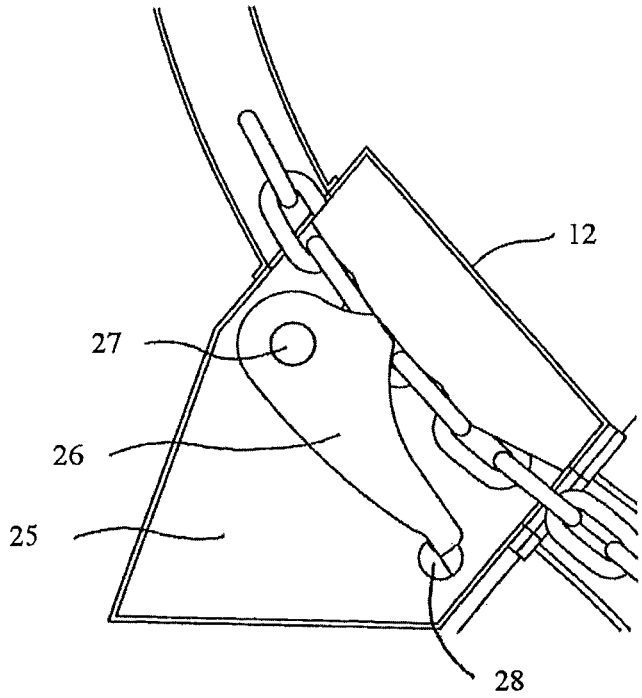

FIGS. 7 and 8 shows the chain stopper from the outside (FIG. 7) and the inside (FIG. 8) of the sealed cavity, 25, when in a locked stand by (for quick release) position. The mechanism on the outside of the cavity includes a stopper rocker arm, 29, mounted on the stopper shaft, 27. On the distant end of the stopper rocker arm, 29, there is a fork, 30, with a pin, 31, sliding in an elongated slotted arm, 32, mounted at one end of a hydraulic stopping device cylinder, 33. The stopping device cylinder is pivotable mounted onto the cavity housing in its other end. The locking mechanism includes a locking rocker arm, 34, mounted on the locking shaft, 28. The locking rocker arm, 28, is in its distant end pivotable connected with the first end of a first link arm, 35. This first link arm, 35, is in its second end connected further to the first end of a second link arm, 36. The second link arm, 36, is pivotable mounted onto the cavity housing in its second end. In the middle of the second link arm, 36, there is a pin, 37, sliding in an elongated slotted member, 38, mounted at one end of a locking device cylinder, 39. The other end of the locking device cylinder is pivotable mounted to the cavity housing, 12.

Figure 9:
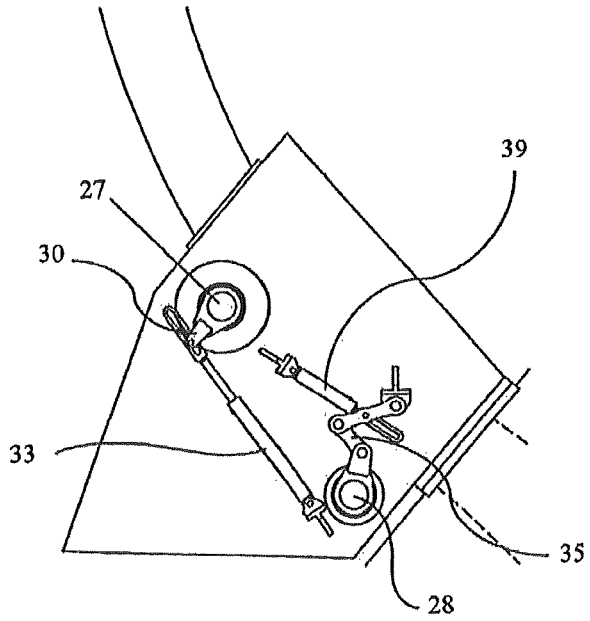
FIGS. 9 and 10 shows the chain stopper arrangement when the chain is released.
Figure 10:
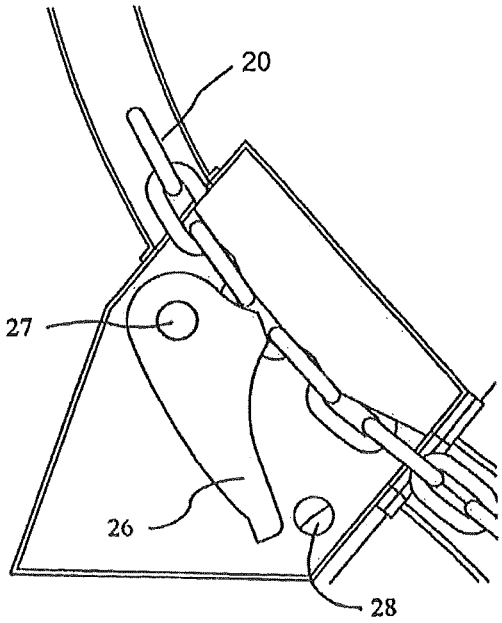

FIGS. 9 and 10 shows the mechanism inside and outside the cavity housing when the chain is released. Chain release under tension is accomplished by locking device cylinder, 39, contracting to buckle the locking device link arms, 35, 36, allowing the locking device shaft, 28, to rotate freeing the end, 20, of the chain stopping device, 26. The tension in the chain causes the chain stopping device to rotate. The slotted member, 32, on the chain stopping device cylinder allows for this rotation without extension of the cylinder.

Figure 11:
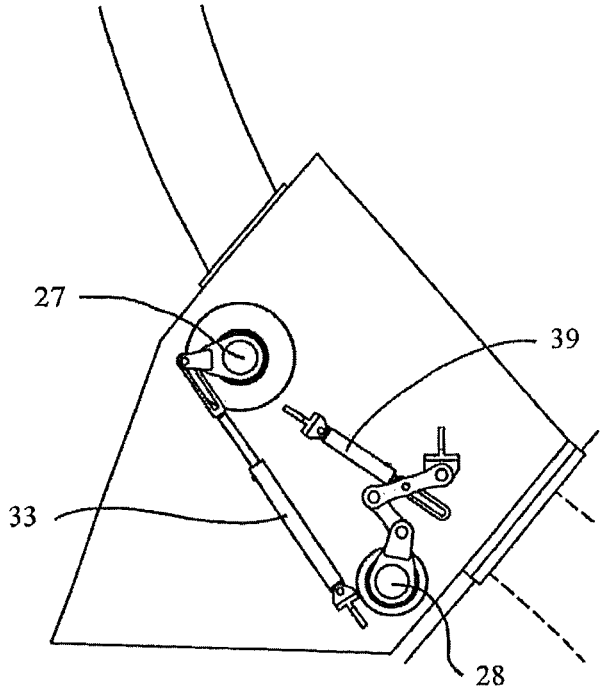
FIGS. 11 and 12 shows the chain stopper arrangement when the chain has been fully released.
Figure 12:
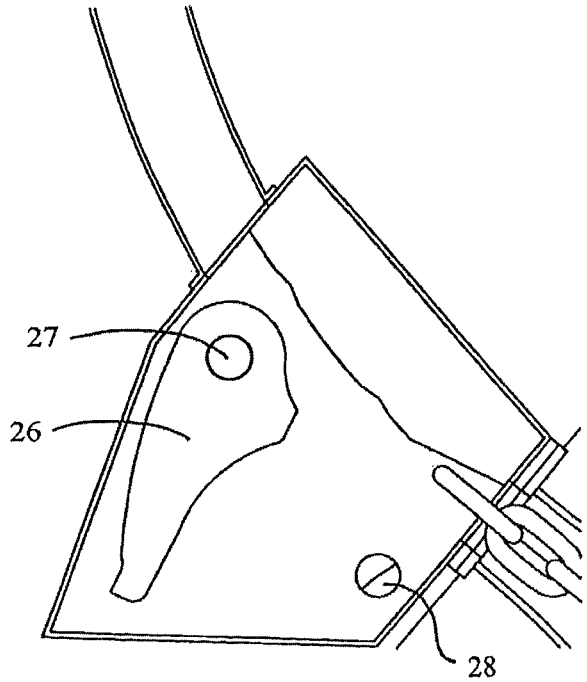

FIGS. 11 and 12 show the chain stopper in full release. Then, the chain is rushing out through the hawsehole to rest on the seabed, 8.

Figure 13:
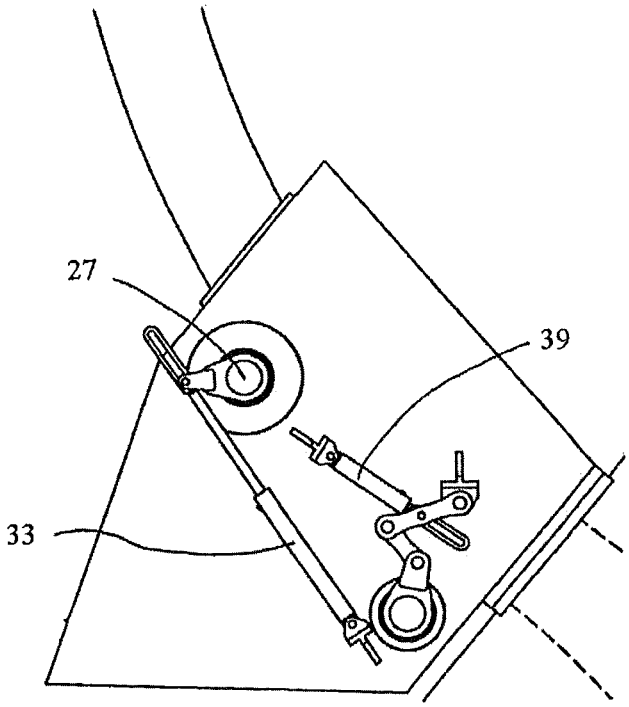
FIGS. 13 and 14 shows the chain stopper arrangement when the mooring line is being pulled into the stopper.
Figure 14:
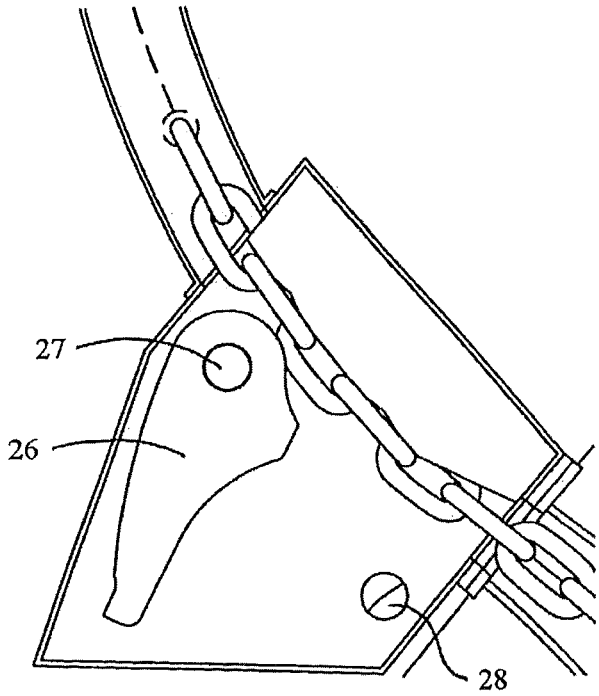

The next step is to fish up the chain from the sea. This is made by gripping the retrieval buoy, bring it up to the surface and fasten a pull-in line to the end of the top chain link. Then, the chain may be hauled through the hawsehole and up to the winch. This is illustrated in FIGS. 13 and 14. The chain stopping device cylinder, 33, is actively in use to hold the device in open position when the mooring line, 4, is being pulled into the stopper.

Figure 15:
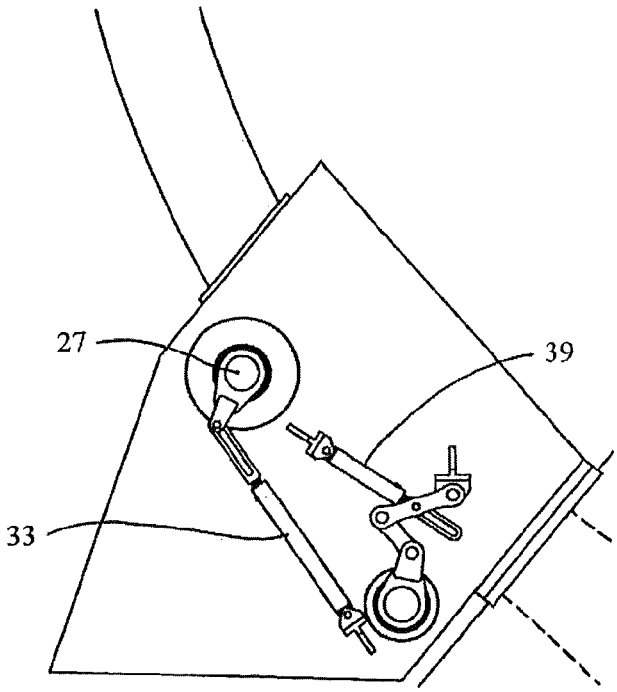
FIGS. 15 and 16 shows the chain stopper when again holding the chain.
Figure 16:
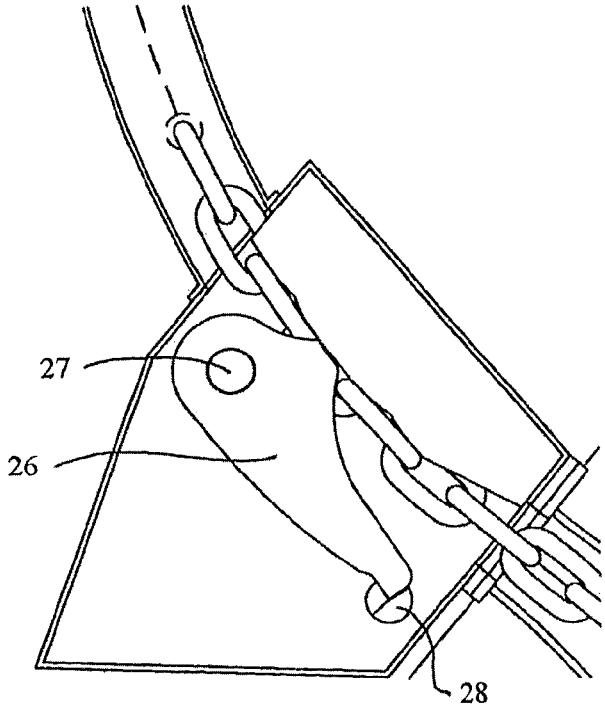

The chain stopping device cylinder is also used to hold the stopping device in closed position when the chain has entered the stopper and until the locking device has been activated. See FIGS. 15 and 16. The last step will be to turn the locking device shaft to lock the stopping device.

Components of the chain stopping arrangement; retrieval buoy and mid-line spring buoy.

Figure 17:
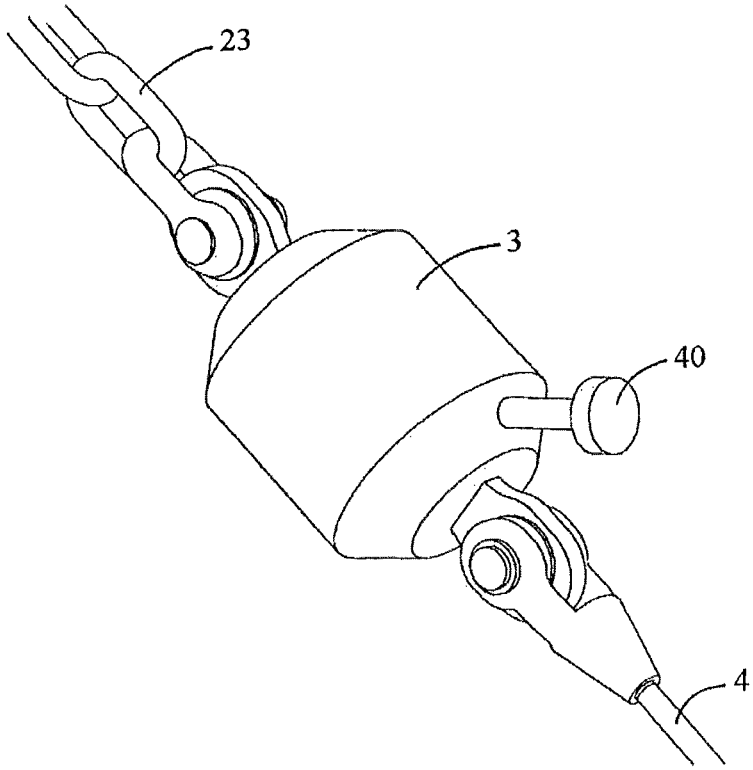
FIG. 17 shows the retrieval buoy in detail.

To facilitate pick up of the mooring line, 4, from the sea bed a retrieval buoy, 3, may be fitted between the upper rope section of the mooring line, 4, and the top chain, 23. The buoy has enough reserve buoyancy to ensure that it comes to rest above the sea bed. The buoy is equipped with a grab handle, 40, which orients in a favourable way to ease pick up. See FIGS. 4 and 17.

Figure 5:
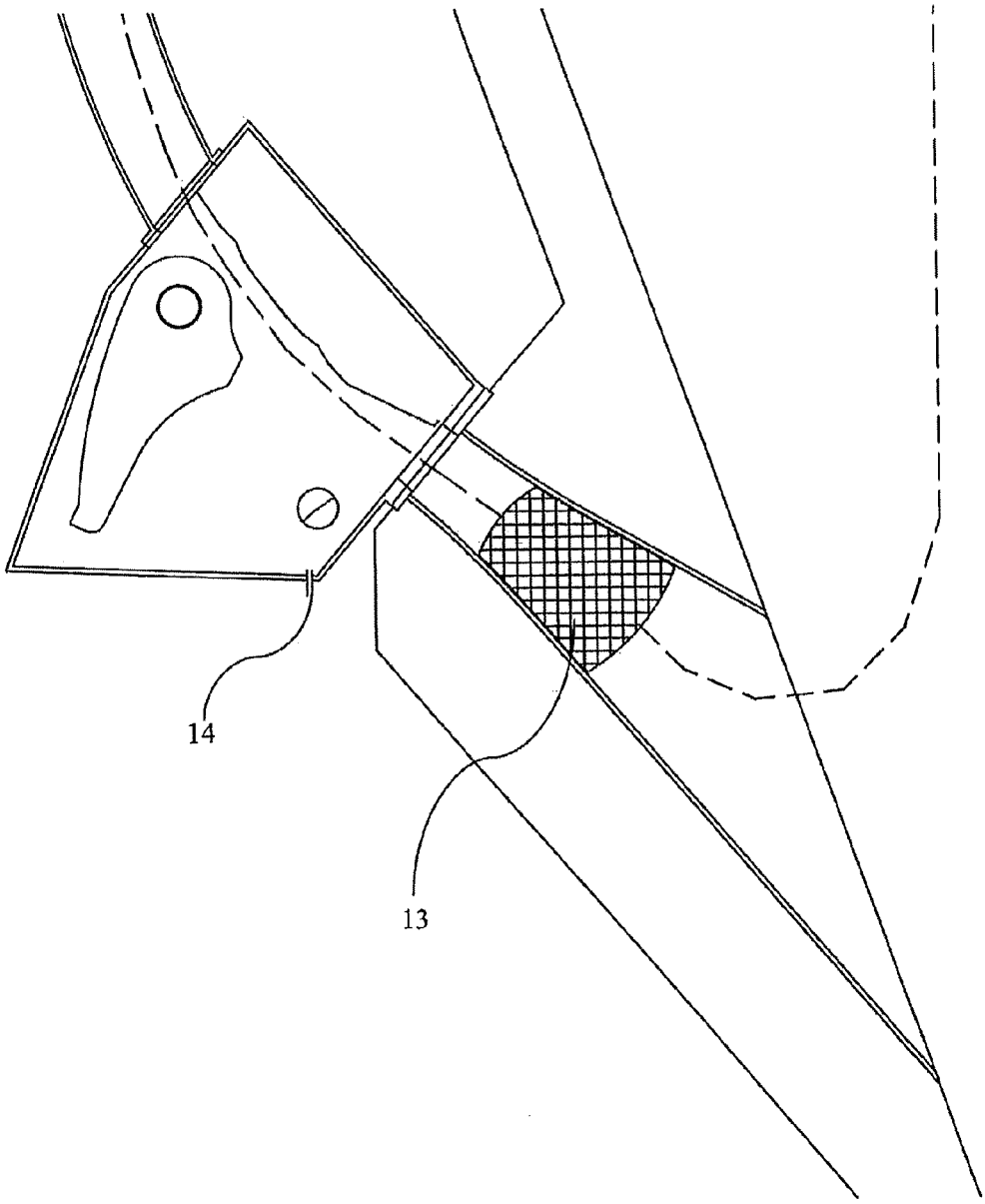
FIG. 5 illustrates how the chain stopper cavity may be sealed off for maintenance.

FIG. 5 shows an embodiment of how the chain stopper cavity may be sealed off for maintenance. The chain stopper and the chain pipe have a sealed connection sealing of hawsehole guide with a tailored wedge shaped plug, 13.

The inner cavity of the chain stopper can be accessed, or the complete chain stopper can be removed by means of the following procedure:

1. Sealing of hawsehole guide with a tailored wedge shaped plug, 13.
2. Draining, 14, the chain stopper and chain pipe of sea water.
3. Removal of chain stopper side plate or;
4. Removal of the lower section of chain pipe,
5. Removal of chain stopper,
6. Secure the opening in Foundation Plate with a covering plate.

The function of the mid-line spring buoy, 5, is during a quick release to pull the top end chain, 23, and upper mooring line, 4, section horizontally towards the anchor position reducing the chance of the mooring lines, 4, entangling and to protect any sub sea installations.

It needs to be designed with sufficient buoyancy to support the mooring line, 4, section from itself and upwards to the retrieval buoy, 3, and be placed along the length of the mooring line, 4, to ensure functionality.

The invention claimed is:

1. A mooring arrangement for a semi-submersible offshore structure having an outer hull with a lower and an upper water line, said mooring arrangement comprising:

a mooring line extending from a fixed point on the seabed to an attachment on the offshore structure, at least a portion of the mooring line closest to the attachment being a chain, and the attachment comprising a hawse and chain stopper located below said lower water line, wherein the chain stopper comprises a water tight housing which is located in a dry space inside the outer hull, wherein the chain stopper housing is sealingly attached at one side to the hawse and at the opposite side to a chain pipe which extends inside said hull to above said upper water line and wherein the hawse extends outwards from the chain stopper housing to, and sealingly with, an opening in said outer hull.

2. A mooring arrangement according to claim 1, wherein the hawse is a bellmouth, with a polygonal cross-section.

3. A mooring arrangement according to claim 1, wherein a buoy having a grab handle is attached to the mooring line at a predetermined distance from the hawse.

4. A mooring arrangement according to claim 1, wherein the chain stopper water tight housing to which the hawse and chain pipe are attached, comprises a chain stopping element and its releasable locking device which are pivotably supported on separate rotatable shafts, said shafts penetrating sealingly a side wall of the housing to the outside thereof, moving means on the outside being connected to the shafts for moving said stopping element and locking device between their locking and releasing positions.

5. A mooring arrangement according to claim 1, wherein, when a chain is not present, a stopper is introducible into the hawse through said opening in the outer shell to close the hawse, thereby permitting the hawse, chain stopper and chain pipe to be drained and the chain stopper to be repaired, maintained or replaced under dry conditions.

6. A mooring arrangement according to claim 1, wherein, in normal operation, the chain is held in the chain stopper at one link located 2-6 links from its inner end.

7. A mooring arrangement according to claim 1, wherein, in normal operation, less than ten links of the chain may come into contact with the surfaces of the hawse, and wherein any relative lateral movement between the chain and chain stopper is taken up between two defined chain links, whereof the one closest to the holding point in the chain stopper is held stationary.

8. A mooring line arrangement according to claim 1, wherein retrieval buoy is attached to the chain at or near its connection to the main mooring line, the buoy having sufficient buoyancy to lift at least a minor part of the chain off the seabed when the chain has come to rest on the seabed after having been released from said vessel.

9. A mooring arrangement according to claim 8, wherein the buoy has a grab handle for retrieval purposes.

10. A mooring arrangement according to claim 8, wherein a spring buoy is attached to the main mooring line at a predetermined distance from the retrieval buoy, said distance being more than half and less than three quarters of the water depth.

* * * * *

UNITED STATES PATENT AND TRADEMARK OFFICE

CERTIFICATE OF CORRECTION

PATENT NO. : 8,544,400 B2
APPLICATION NO. : 13/054779
DATED : October 1, 2013
INVENTOR(S) : Jon Hovik It is certified that error appears in the above-identified patent and that said Letters Patent is hereby corrected as shown below:

In the Specification:

Column 1, Line 28: Please correct "in Artie waters"
to read -- in Arctic waters --

In the Claims:

Column 6, Claim 8, Lines 6 and 7:
Please correct "A mooring line arrangement according to claim 1, wherein retrieval buoy is attached"
to read -- A mooring arrangement according to claim 1, wherein a retrieval buoy is attached --

Signed and Sealed this
Fifteenth Day of April, 2014

Michelle K. Lee

Michelle K. Lee
*Deputy Director of the United States Patent and Trademark Office*